US006198231B1

(12) United States Patent
Schemmel et al.

(10) Patent No.: US 6,198,231 B1
(45) Date of Patent: Mar. 6, 2001

(54) CIRCUIT CONFIGURATION FOR OPERATING AT LEAST ONE DISCHARGE LAMP

(75) Inventors: Bernhard Schemmel, Wessling; Bernd Rudolph, Munich; Michael Weirich, Unterhaching, all of (DE)

(73) Assignee: Patent-Treuhand-Gesellschaft fuer elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/446,461

(22) PCT Filed: Apr. 1, 1999

(86) PCT No.: PCT/DE99/01011

§ 371 Date: Dec. 22, 1999

§ 102(e) Date: Dec. 22, 1999

(87) PCT Pub. No.: WO99/56506

PCT Pub. Date: Nov. 4, 1999

(30) Foreign Application Priority Data

Apr. 29, 1998 (DE) ..... 198 19 027

(51) Int. Cl.[7] ..... H05B 37/02

(52) U.S. Cl. ..... 315/225; 315/119; 315/209 R; 315/291; 315/DIG. 7

(58) Field of Search ..... 315/209 R, 291, 315/307, 244, 225, 119, 312, 226, DIG. 5, DIG. 7

(56) References Cited

U.S. PATENT DOCUMENTS

| | | | |
|---|---|---|---|
| 4,477,748 | 10/1984 | Grubbs | 315/306 |
| 5,262,699 | 11/1993 | Sun et al. | 315/209 R |
| 5,332,951 | 7/1994 | Turner et al. | 315/209 R |
| 5,783,911 * | 10/1998 | Rudolph | 315/225 |
| 5,825,136 * | 10/1998 | Rudolph | 315/291 |

FOREIGN PATENT DOCUMENTS

| | | |
|---|---|---|
| 0681414 | 11/1995 | (EP) . |
| 0696157 | 2/1996 | (EP) . |
| 0753987 | 1/1997 | (EP) . |

* cited by examiner

*Primary Examiner*—Haissa Philogene
(74) *Attorney, Agent, or Firm*—Carlo S. Bessone

(57) ABSTRACT

The invention relates to a circuit arrangement for operating at least one discharge lamp (LP) on a half-bridge inverter (Q1, Q2), having at least one coupling capacitor (C3) and having a switch-off device (T1, A) which permanently switches off the half-bridge inverter (Q1, Q2) when the lamp (LP) refuses to start. According to the invention, the circuit arrangement has first and second devices (V1, V2) for monitoring the voltage drop across the at least one coupling capacitor (C3) and for activating the switch-off device (T1, A) as a function of the voltage drop detected across the at least one coupling capacitor (C3). If the voltage across the coupling capacitor (C3) deviates substantially from its normal value, for example owing to the occurrence or the rectifying effect at the end of the service life of the discharge lamp (LP), the half-bridge inverter (Q1, Q2) is shut down by the switch-off device (T1, A).

13 Claims, 2 Drawing Sheets

CIRCUIT CONFIGURATION FOR OPERATING AT LEAST ONE DISCHARGE LAMP

FIELD OF THE INVENTION

The invention relates to a circuit arrangement for operating at least one discharge lamp.

I. BACKGROUND OF THE INVENTION

A known circuit arrangement is disclosed, for example, in the Laid-Open Patent Specification EP 0 753 987 A1. This circuit arrangement has a half-bridge inverter with a switch-off device which switches off the half-bridge inverter in the case of an anomalous operating state—for example in the case of a lamp which refuses to start or is defective. The switch-off device has a field effect transistor whose drain-source path is arranged in the control circuit of a half-bridge inverter transistor and switches the control circuit between a low-resistance and a high-resistance state. Upon the occurrence of an anomalous operating state, the switch off is performed synchronously with the blocking phase of that half-bridge inverter transistor in whose control circuit the field effect transistor is arranged. The switch-off device of this circuit arrangement certainly switches the half-bridge inverter off reliably in the case of a lamp which refuses to start, but it reacts in general too insensitively to the occurrence of the so-called rectifying effect of the discharge lamp, which will be explained in more detail below.

A possible cause of failure of discharge lamps, in particular of low-pressure discharge lamps, is occasioned by a reduction over the lifetime of the lamp in the ability of the lamp electrodes to emit. Since the loss of the ability to emit generally proceeds with varying intensity in the two lamp electrodes over the lifetime of the lamp, at the end of the lifetime of a discharge lamp operated with alternating current a preferred direction has been formed for the discharge current through the discharge lamp. The discharge lamp develops a current-rectifying effect in this case. This effect is designated as a rectifying effect of the discharge lamp. Owing to the occurrence of the rectifying effect in the discharge lamp, the lamp electrode incapable of emission is heated extremely, with the result that impermissibly high temperatures can occur which can even cause melting of the lamp bulb glass.

Moreover, in the case of discharge lamps which are operated on a half-bridge inverter, the rectifying effect of the discharge lamp causes a substantial deviation in the voltage drop across the coupling capacitor or the coupling capacitors from the normal value, which is usually half as large as the value of the input voltage of the half-bridge inverter. In the case of self-oscillating half-bridge inverters, this deviation in the voltage drop across the coupling capacitor or the coupling capacitors leads to stopping the oscillation of the half-bridge inverter, because the supply voltage of one of the two half-bridge branches is in this case too low to maintain the feedback. However, immediately after being interrupted the oscillation of the half-bridge inverter is set going again by the starting circuit of the half-bridge inverter if the switch-off device is not triggered. As a result, the discharge lamp affected by the rectifying effect is not reliably switched off, but flickers instead.

II. SUMMARY OF THE INVENTION

It is the object of the invention to provide a circuit arrangement for operating at least one discharge lamp with an improved switch-off device which does not have the disadvantages of the prior art. In particular, the aim is for the switch-off device to detect the occurrence of the rectifying effect of the at least one discharge lamp and to switch off the half-bridge inverter permanently in this case.

The circuit arrangement according to the invention, which has a half-bridge inverter with a downstream load circuit, at least one coupling capacitor connected to the load circuit and the half-bridge inverter, as well as terminals for at least one discharge lamp and a switch-off device for switching off the half-bridge inverter upon the occurrence of an anomalous operating state, has, according to the invention, means for monitoring the voltage drop across the at least one coupling capacitor and for activating the switch-off device as a function of the voltage drop detected across the at least one coupling capacitor.

As already explained further above, the occurrence of the rectifying effect of the at least one discharge lamp causes a substantial deviation in the voltage drop across the at least one coupling capacitor from its normal value, which is half as large as the input voltage of the half-bridge inverter. With the aid of the above named means according to the invention, the occurrence of the rectifying effect of the at least one discharge lamp is detected by using these means to monitor the voltage drop across the at least one coupling capacitor, and activating the switch-off device when the voltage drop across the at least one coupling capacitor deviates substantially from its normal value.

The above named means according to the invention advantageously have a first device for activating the switch-off device upon a predetermined upper limiting value of the voltage drop across the at least one coupling capacitor being reached, and a second device for activating the switch-off device upon a predetermined lower limiting value of the voltage drop across the at least one coupling capacitor being reached. The upper and the lower limiting values must be preset so that a slight asymmetry in the case of the lamp electrodes does not already lead to activation of the switch-off device. For this reason, the upper limiting value is advantageously not less than 75 percent of the input or supply voltage of the half-bridge inverter, and the lower limiting value is advantageously at most 25 percent of the input or supply voltage of the half-bridge inverter.

The first and/or second device advantageously have at least one electric component with a nonlinear current-voltage characteristic which is connected to the at least one coupling capacitor and to the at least one control input of the switch-off device. With the aid of such an electric component with a nonlinear current-voltage characteristic, the upper or lower limiting value of the voltage drop across the at least one coupling capacitor for which the switch-off device is activated by the first or second device can be preset to the desired level. Components from the group of diode, Zener diode, suppressor diode and varistor are advantageously suitable as electric components with a non-linear current-voltage characteristic. Furthermore, the switch-off device of the circuit arrangement according to the invention advantageously has at least two control or regulating inputs, specifically one each for the first device and the second device. A control input is advantageously additionally connected in parallel in terms of alternating current with the at least one discharge lamp, in order to monitor the voltage drop across the terminals for the at least one discharge lamp. In order to ensure that the half-bridge inverter is switched off as reliably and permanently as possible during a malfunction or upon the occurrence of the rectifying effect of the at least one discharge lamp, the switch-off device of the circuit arrangement according to the invention advantageously has a bistable switching device. A thyristor equivalent circuit constructed from two transistors is particularly well suited as bistable switching device, since said circuit already has available two separate control inputs which can be used by the first and the second device to activate the switch-off device. The first device advantageously comprises an electric component with a nonlinear current-voltage characteristic, and a diode connected in series therewith, the anode of the diode being connected to a lamp terminal and to the at least one coupling capacitor, while the cathode of this diode is connected to the electric component with the nonlinear current-voltage characteristic, this electric component being connected to the first control input of the switch-off device. The second device advantageously comprises the series circuit of at least one diode with at least one resistor, this series circuit being connected, on the other hand, to the at least one coupling capacitor and a lamp terminal, and being connected, on the other hand, to the second control input of the switch-off device.

III. DESCRIPTION OF THE PREFERRED EXEMPLARY EMBODIMENTS

Figure 1:
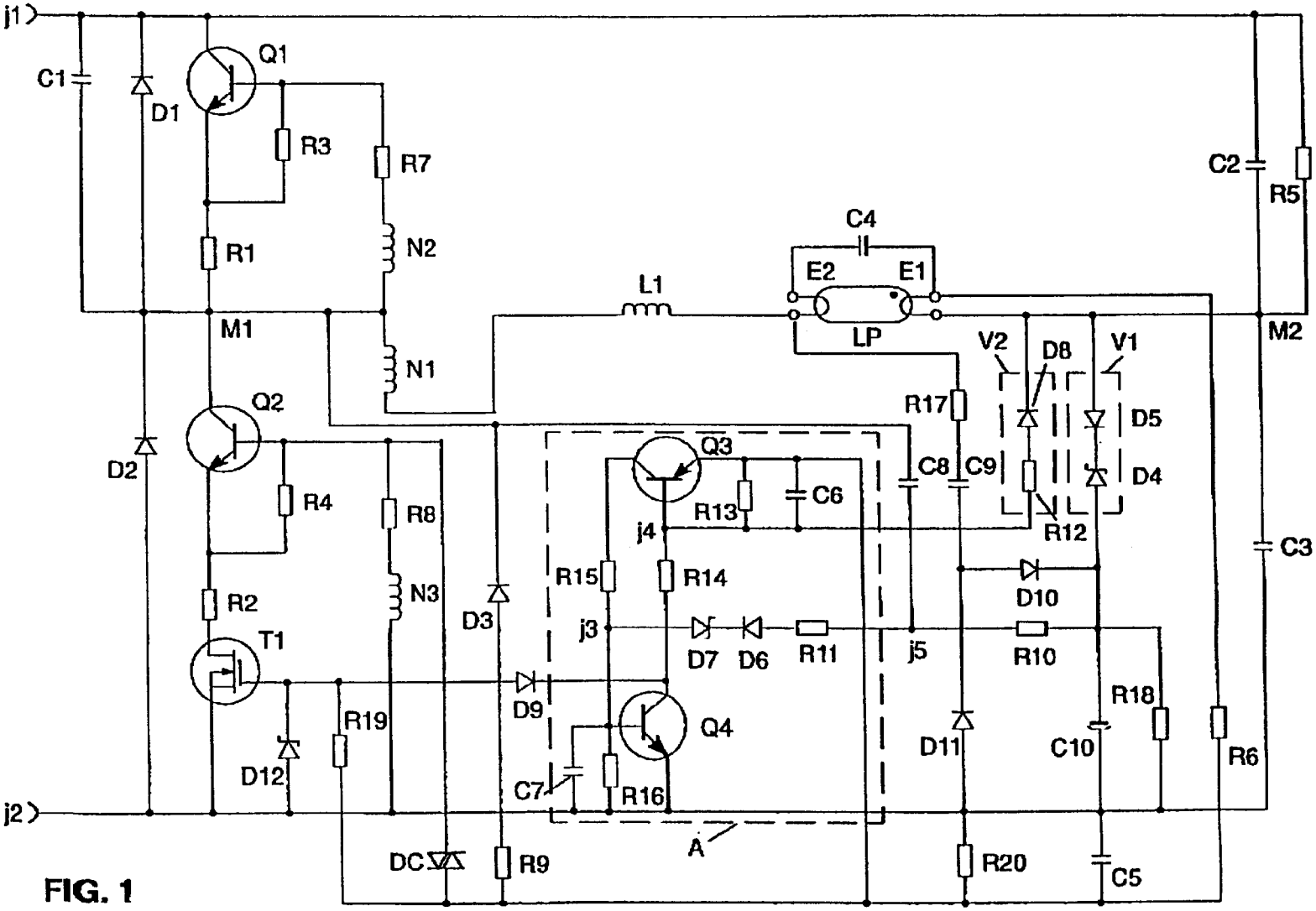
FIG. 1 is a circuit diagram of a first embodiment of the present invention.

The invention is explained below in more detail with the aid of two preferred exemplary embodiments. A sketch of the circuit arrangement in accordance with the first preferred exemplary embodiment is illustrated in FIG. 1. This circuit arrangement serves to operate a fluorescent lamp. It has a freely oscillating half-bridge inverter which is fitted with two bipolar transistors Q1, Q2 and draws its input or supply voltage via the DC voltage terminals j1, j2. The DC voltage terminal j2 is connected to frame potential, and a voltage of approximately +400 V is provided at the DC voltage terminal j1. This input or supply voltage is generated from the rectified AC supply voltage with the aid of an upstream step-up converter, for example (not shown in the figure). Furthermore, a radio interference suppression filter known per se (likewise not illustrated) is connected upstream of the supply voltage rectifier.

Two bipolar transistors Q1, Q2 of the half-bridge inverter are provided in each case with a freewheeling diode D1, D2 which are connected in parallel with the collector-emitter path of the corresponding transistor Q1, Q2. Moreover, the two bipolar transistors Q1, Q2 respectively have an emitter resistor R1, R2 and a base-emitter shunt resistor R3, R4. Furthermore, a capacitor C1 is arranged in parallel with the collector-emitter path of the transistor Q1. The two switching transistors Q1, Q2 of the half-bridge inverter are driven by means of an annular core transformer which has a primary winding N1 and two secondary windings N2, N3. The primary winding N1 is connected into the load circuit, designed as a series resonant circuit, of the half-bridge inverter. The load circuit is connected to the centre tap M1 between the bipolar transistors Q1, Q2 of the half-bridge inverter, and to the centre tap M2 between the two coupling capacitors C2, C3. The load circuit comprises the primary winding N1, a resonance inductor L1, a resonance capacitor C4 and respectively two terminals for the two electrode filaments E1, E2 of a fluorescent lamp LP. The resonance capacitor C4 is connected in parallel with the discharge path of the fluorescent lamp LP. The secondary windings N2, N3 are respectively arranged in the base-emitter junction of a bipolar transistor Q1, Q2, and connected to the base terminal of the relevant inverter transistor Q1, Q2 series, in each case via a base resistor R7, R8. The half-bridge inverter further has a starting device which essentially comprises the Diac DC, which is connected to the base terminal of the bipolar transistor Q2, and the starting capacitor C5, which is connected, on the one hand, to the terminal j2, which is at frame potential, and, on the other hand, via a resistor R9 and a rectifying diode D3 to the centre tap M1 of the half-bridge inverter, as well as the resistor R20 arranged in parallel with the starting capacitor C5. The starting circuit ensures the build-up of the half-bridge inverter after the circuit arrangement is switched on.

The coupling capacitors C2, C3 each have a parallel resistor R5, R6. With the aid of the coupling capacitors C2, C3 and their parallel resistors R5, R6, a voltage drop which, in the ideal case, is half as large as the input or supply voltage of the half-bridge inverter provided at the terminals j1, j2, is generated at the centre tap M2 between the coupling capacitors C2, C3. In the ideal case, the voltage drop at the centre tap M2 and across the coupling capacitor C3 is therefore approximately +200 V in the case of an input voltage of approximately +400 V of the half-bridge inverter. In reality, the voltage drop at the centre tap M2 and across the coupling capacitor C3 deviates slightly from this ideal value.

The circuit arrangement according to the invention also has a switch-off device which switches off the half-bridge inverter Q1, Q2 upon the occurrence of an anomalous operating state, that is to say in the case of a discharge lamp LP which refuses to start or is defective. The switch-off device essentially comprises a field effect transistor T1 whose drain-source path is connected in series with the emitter resistor R2 of the inverter transistor Q2, and a thyristor equivalent circuit A which is formed by the bipolar transistors Q3, Q4, as well as an error-signal monitoring unit which comprises the capacitors C8, C9, C10, the diodes D6, D7, D10, D11 and the resistors R10, R11, R17, R18. The thyristor equivalent circuit A has two control inputs. The first control input of the thyristor equivalent circuit is connected to the base terminal of the npn transistor Q4, while its second control input is connected to the base terminal of the pnp transistor Q3. The output of the thyristor equivalent circuit A at the collector terminal of the transistor Q4 is connected via a diode D9 to the gate of the field effect transistor T1, the anode of the diode D9 being connected to the gate of the transistor T1, and its cathode being connected to the collector of the transistor Q4. Furthermore, the gate terminal of the field effect transistor T1 is connected to the terminal j1 via the resistors R19, R6, R5 and via an electrode filament of the discharge lamp LP. Moreover, connected in parallel with the gate-source path of the field effect transistor T1 is a Zener diode D12 which serves as overvoltage protector for the transistor T1. The first control input of the thyristor equivalent circuit A is driven by means of the error-signal monitoring unit.

With the aid of the RC integration element R17, C10, the rectifier diode D10 and the capacitor C9, the error-signal monitoring unit generates a smooth DC voltage which is present across the capacitor C10 and is proportional to the voltage drop across the discharge lamp LP. The abovementioned components are connected in parallel in terms of alternating current with the discharge path of the discharge lamp LP. The positive pole of the capacitor C10 is connected to a terminal of the electrode filament E2 of the discharge lamp LP via the components R10, C9, R17, and is connected to. the first control input j3 of the thyristor equivalent circuit A via the components R10, R11, D6, D7. Moreover, by means of the CR series circuit C8, R10, which forms a differentiating element, the error-signal monitoring unit generates a synchronization signal which is obtained by differentiating the trapezoidal output voltage, present at the centre tap M1, of the half-bridge inverter Q1, Q2. A square-wave voltage whose positive half wave is generated by the leading edge and whose negative half wave is generated by the trailing edge of the trapezoidal half-bridge inverter output voltage is therefore present at the resistor R10. The leading edge of the trapezoidal half-bridge inverter output voltage is produced by switching off the transistor Q2, while the trailing edge of the trapezoidal half-bridge inverter output voltage is produced by switching off the transistor Q1. Present at the centre tap j5 of the differentiating element C8, R10 is a voltage which is composed additively of the voltage drop across the capacitor C10 and the voltage drop across the resistor R10. This voltage is fed to the first control input j3 of the thyristor equivalent circuit via the Zener diode D7. The error-signal monitoring unit and its cooperation with the thyristor equivalent circuit A and the field effect transistor T1 are described in detail in the Laid-Open Specification EP 0 753 987.

Furthermore, the circuit arrangement illustrated in the figure has a first device Vi and a second device V2 for activating the switch-off device, which are connected to the first and, respectively, to the second control input of the thyristor equivalent circuit A. The first device V1 comprises the series circuit of a Zener diode D4 with a diode D5, the anode of the diode D5 being connected to the centre tap M2 between the coupling capacitors C2, C3 and to a terminal of the electrode filament E1 of the discharge lamp LP, and the cathode of the diode D5 being connected to the cathode of the Zener diode D4. The anode of the Zener diode D4 is connected to the first control input at the base terminal of the transistor Q4 of the thyristor equivalent circuit A via the resistors R10, R11, the diode D6, which is polarized in the same sense as the diode D5, and via a further Zener diode D7, which is polarized in the same sense as the Zener diode D4. The second device V2 comprises the series circuit of a diode D8 with a resistor R12. The cathode of the diode D8 is connected to the centre tap M2 and to the same terminal of the electrode filament E1 of the discharge lamp LP as the anode of the diode D5. The anode of the diode D8 is connected to the resistor R12, which is connected, for its part, to the second control input at the base terminal of the transistor Q3 of the thyristor equivalent circuit A. In addition to the transistors Q3, Q4, as further components the thyristor equivalent circuit A includes the capacitors C6, C7 and the resistors R13, R14, R15, R16. The mode of operation of a thyristor equivalent circuit constructed from two transistors is described, for example, on pages 395 to 396 in the book entitled "Bauelemente der Elektronik und ihre Grundschaltungen" ["Electronic Components and their Basic Circuits"] by H. Höger, F. Kähler, G. Weigt from the series entitled "Einführung in die Elektronik" ["Introduction to Electronics"], Vol. 1, published by H. Stam GmbH, $7^{th}$ Edition.

The mode of operation of the above described circuit arrangement is explained in more detail below for the case of normal operation, that is to say given an acceptably operating discharge lamp, and for the case of the anomalous operating state, that is to say a discharge lamp which refuses to start, or in the case of the occurrence of the rectifying effect of the discharge lamp. A suitable dimensioning of the components used is specified in the table.

Normal Operation

In the case of normal operation, after the discharge lamp or the circuit arrangement has been switched on the DC voltage supply for the half-bridge inverter Q1, Q2 builds up at the terminals j1, j2. The drain-source path of the field effect transistor T1, whose gate is connected via the resistors R19, R6, the electrode filament E1 and the resistor R5 to the terminal j1, which is at approximately +400 V, is put into the low-resistance state. Furthermore, the starting capacitor C5 is charged via the resistor R5, the electrode filament E1 and the resistor R6 to the breakdown voltage of the Diac DC, which then generates trigger pulses for the base of the bipolar transistor Q2 and thereby causes the half-bridge inverter Q1, Q2 to build up. After the transistor Q2 has been turned on, the starting capacitor C5 is discharged via the resistor R9 and the diode D3 to such an extent that the Diac DC generates no further trigger pulses. Present at the two coupling capacitors C2, C3 in each case is half the input voltage of the half-bridge inverter Q1, Q2, with the result that the centre tap M2 between the coupling capacitors C2, C3 is located at an electric potential of approximately +200 V. The two half-bridge inverter transistors Q1, Q2 switch in an alternating fashion, so that the centre tap M1 between the transistors Q1, Q2 is connected alternately to the positive pole j1 (+400 V) and the negative pole j2 (frame potential) of the DC voltage supply of the half-bridge inverter. As a result, a medium-frequency alternating current whose frequency corresponds to the switching frequency of the half-bridge inverter flows in the load circuit between the centre taps M1 and M2. During the switching pauses, in which both transistors Q1, Q2 block, the load circuit current is maintained by means of the resonant inductor L1 and flows via one of the two freewheeling diodes D1, D2. Usually, the electrode filaments E1, E2 of the fluorescent lamp LP have a heating current applied to them by means of a heating device (not illustrated) before the lamp is started, and are preheated in this way. In order to start the gas discharge in the discharge lamp LP, the starting voltage required for the purpose is provided at the resonance capacitor C4 by means of the method of resonant increase. That is to say, the switching frequency of the half-bridge inverter is approximated to the resonant frequency of the series resonance circuit L1, C4. After the lamp has been started, the resonance circuit L1, C4 is damped by the then conductive discharge path of the discharge lamp LP. The transistors Q3, Q4 of the thyristor equivalent circuit A are in the blocked state during normal operation, and the switch-off device is deactivated.

Switching Off the Half-bridge Inverter in the Case of a Discharge Lamp which Refuses to Start (Anomalous operating state)

Lacking the discharge lamp LP, the half-bridge inverter Q1, Q2 cannot build up, since the connection of the starting capacitor C5 to the voltage supply terminal j1 is led via the terminals for the electrode filament E1. A discharge lamp LP which refuses to start, or a defective discharge lamp LP which has, for example, an operating voltage which has increased due to ageing, causes an increased voltage drop across the capacitor C10. The positive voltage peaks of the synchronization signal generated by the differentiating element C8, R10 are added at the tap j5 to the voltage of the capacitor C10. As a result, the threshold voltage of the Zener diode D7 is exceeded and the transistors Q3, Q4 of the thyristor equivalent circuit A are switched into the conductive state via the first control input j3. The gate of the field effect transistor T1 is now connected to the frame potential via the diode D9 and the conductive collector-emitter path of the bipolar transistor Q4. The drive signal is therefore extracted from the gate of the field effect transistor T1, and the drain-source path of the field effect transistor T1 goes over into the high-resistance or blocked state. Consequently, the half-bridge inverter Q1, Q2 is shut down, and cannot be restarted until the discharge lamp LP is switched on again or exchanged, since the thyristor equivalent circuit A is reset into the blocked state of the normal operation again only by interruption of the voltage supply. This switching off of the half-bridge inverter is performed synchronously with the blocking phase of the transistor Q2. After the half-bridge inverter has been switched off, the capacitor C10 is discharged via its parallel resistor R18.

Switching Off the Half-bridge Inverter Upon the Occurrence of the Rectifying Effect of the Discharge Lamp (Anomalous operating state)

The switch-off device T1, A of the half-bridge inverter Q1, Q2 is activated either by means of the first device V1 or by means of the second device V2 upon the occurrence of the rectifying effect in the discharge lamp LP. As already mentioned further above, the rectifying effect causes the discharge lamp LP to exert a rectifying effect on the medium-frequency load circuit current which flows between the centre taps M1 and M2. Depending on which current direction is preferred as a result of the rectifying effect of the discharge lamp LP, the voltage drop across the coupling capacitor C3 and the electric potential at the centre tap M2 are increased or decreased. The rectifying effect of the discharge lamp LP causes a deviation of the voltage drop across the coupling capacitor C3 from its normal value, which is approximately +200 V. If the deviation of the voltage drop across the coupling capacitor C3 from its normal value has risen to virtually 100%, the switch-off device T1, A is activated by the first device V1 or the second device V2.

If the voltage drop across the coupling capacitor C3 is approximately +400 V, which corresponds to the entire input voltage of the half-bridge inverter, the threshold voltage of the Zener diode D4 of the first device V1 is reached, and the capacitor C10 is charged to such an extent that the voltage drop across the capacitor C10 and the synchronization signal, added thereto at the tap j5, of the differentiating element C8, R10 reach the threshold voltage of the Zener diode D7, and the transistors Q3, Q4 of the thyristor equivalent circuit A are switched into the conductive state via the first control input j3. As a result, the drain-source path of the field effect transistor T1 is blocked, and the half-bridge inverter Q1, Q2 is shut down synchronously with the blocking phase of the transistor Q2.

If the voltage drop across the coupling capacitor C3 is very slight and the centre tap M2 is therefore virtually at frame potential, the pnp transistor Q3 of the thyristor equivalent circuit A is firstly turned on via the second control input j4, which is connected to the centre tap M2 by the series circuit D8, R12 of the second device V2, and subsequently the npn transistor Q4 is switched into the conductive state as well. Once again, the gate drive signal is extracted thereby from the field effect transistor T1, with the result that the drain-source path thereof goes over into the blocked state and the half-bridge inverter Q1, Q2 is shut down. The thyristor equivalent circuit A is not reset into the blocking state, nor is the switch-off device deactivated until there is an interruption in the current such as is caused, for example, by exchanging the discharge lamp LP or by renewed switching on.

Figure 2:
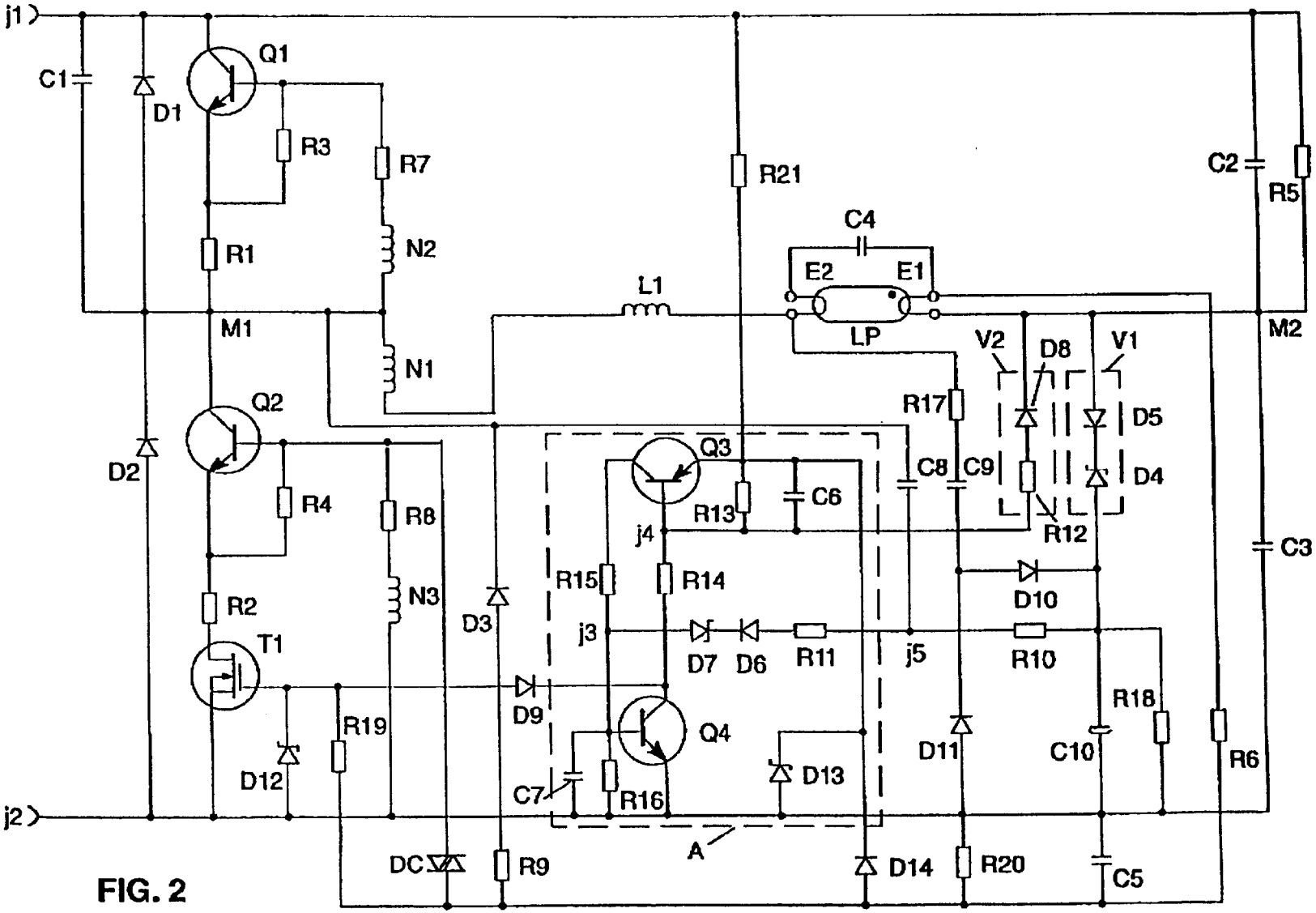
FIG. 2 is a circuit diagram of a second embodiment of the present invention.

A second preferred exemplary embodiment of the invention is illustrated in FIG. 2. This second exemplary embodiment differs from the first exemplary embodiment described in more detail above only in additional components R21, D13 and D14. In the remaining components, the second exemplary embodiment corresponds to the first exemplary embodiment. For this reason, identical reference symbols have also been selected for identical components in FIGS. 1 and 2. The emitter of the transistor Q3 is connected to the voltage supply terminal j1 via the resistor R21. In the case of an anomalous operating state, an additional holding current is provided for the thyristor equivalent circuit A with the aid of this resistor R21. The resistor R21 is dimensioned such that the thyristor equivalent circuit A receives approximately 50 to 80 percent of its holding current via the resistor R21. The remainder of the holding current component, which is required to maintain the switched-on state of the thyristor equivalent circuit A, is provided via the resistor R5, the electrode filament E1 of the low-pressure discharge lamp LP, the resistor R6, and via the diode D14 polarized in the forward direction. Permanent switching on of the thyristor equivalent circuit A is ensured by the additional holding current flowing via the resistor R21, even in the case when the potential at the nodal point M2—caused by the occurrence of the rectifying effect—is virtually at frame potential. The diode D14 serves to decouple the Diac DC from the thyristor equivalent circuit A. The anode of the diode D14 is connected to a nodal point arranged between the Diac DC and the resistor R6, while the cathode of the diode D14 is connected to the emitter of the transistor Q3. The additional Zener diode D13 protects the thyristor equivalent circuit A against overvoltages. For this purpose, the anode of the Zener diode D13 is connected to the voltage supply terminal j2, and its cathode is connected to the emitter of the transistor Q3. The mode of operation of this circuit arrangement corresponds to that of the first exemplary embodiment. Upon the occurrence of an anomalous operating state, the thyristor equivalent circuit A is reset to the blocking state by exchanging the lamp LP, since the DC connection to the resistor R6 in the case of the electrode filament E1 is interrupted by taking out the lamp LP, and the holding current still remaining, and flowing via the resistor R21 is insufficient to leave the thyristor equivalent circuit A in the switched on state.

The invention is not limited to the exemplary embodiments described in more detail above. For example, the invention can also be applied to half-bridge inverters which have only one coupling capacitor. Furthermore, the invention can be used not only in the case of self-oscillating half-bridge inverters, but also in the case of externally controlled half-bridge inverters. Furthermore, the upper limiting value and the lower limiting value of the voltage drop across the coupling capacitor C3, at which the switch-off device is activated, can be set to other values by suitable dimensioning of the components.

TABLE

Dimensioning of the components illustrated in the figures in accordance with the preferred exemplary embodiments

| | |
|---|---|
| R1 | 0.68 Ω |
| R2 | 0.56 Ω |
| R3, R4, R10 | 47 Ω |
| R5, R6 | 560 kΩ |
| R7, R8 | 10 Ω |
| R9, R12 | 22 kΩ |

TABLE-continued

| Dimensioning of the components illustrated in the figures in accordance with the preferred exemplary embodiments | |
|---|---|
| R11 | 2.2 kΩ |
| R13, R14, R15, R16 | 10 kΩ |
| R17 | 470 kΩ |
| R18, R20 | 1 MΩ |
| R19 | 330 kΩ |
| R21 | 5.6 MΩ |
| C1 | 3.3 nF |
| C2, C3 | 200 nF |
| C4 | 6.8 nF |
| C5 | 100 nF |
| C6, C7, C9 | 560 pF |
| C8 | 33 pF |
| C10 | 1 μF |
| D1, D2, D3, D5, D8 | 1N4946 |
| D4 | Zener diode, 370 V |
| D6, D9 | LL4148 |
| D7 | Zener diode, 27 V |
| D10, D11 | 1N4148 |
| D12 | Zener diode, 12 V |
| DC | 1N413M |
| Q1, Q2 | BUF 644 |

TABLE

| Dimensioning of the components illustrated in the figures in accordance with the preferred exemplary embodiments (continuation) | |
|---|---|
| Q3 | BC857A |
| Q4 | BC847A |
| T1 | MTD3055V |
| L1 | 2.2 mH |
| LP | Fluorescent lamp, 32 W |
| N1, N2, N3 | Annular core R 8/4/3.8 |

What is claimed is:

1. A circuit arrangement for operating at least one discharge lamp, the circuit arrangement comprising:

a half-bridge inverter with downstream load circuit, the load circuit having terminals for at least one discharge lamp;

at least one coupling capacitor which is connected to the load circuit and to the half-bridge inverter;

a switch-off device for switching off the half-bridge inverter on the occurrence of an anomalous operating state;

a first device activating the switch-off device upon reaching an upper limiting value of a voltage drop across the at least one coupling capacitor; and a second device activating the switch-off device upon reaching a lower limiting value of the voltage drop across the at least one coupling capacitor.

2. The circuit arrangement according to claim 1, wherein the circuit arrangement has two of the coupling capacitors with a centre tap between the two coupling capacitors, the load circuit being connected to the centre tap between the coupling capacitors.

3. The circuit according to claim 1, wherein the switch-off device has at least one control input, and one of the first and second devices has at least one electric component with a nonlinear current-voltage characteristic, which is connected to the at least one coupling capacitor and to the at least one control input of the switch-off device.

4. The circuit arrangement according to claim 1, wherein the upper limiting value is greater than or equal to 75 percent of the input voltage or supply voltage of the half-bridge inverter.

5. The circuit arrangement according to claim 1, wherein the lower limiting value is less than or equal to 25 percent of the input voltage or supply voltage of the half-bridge inverter.

6. The circuit arrangement according to claim 3, wherein the switch-off device has at least two of the control inputs, the first of the device serving to drive the first control input, and the second device serving to control the second control input.

7. The circuit arrangement according to claim 3, wherein the at least one electric component with a nonlinear current-voltage characteristic is a component from the group consisting of a diode, Zener diode, suppressor diode and varistor.

8. The circuit arrangement according to claim 3, wherein at least one diode is connected in series with the at least one electric component with a nonlinear current-voltage characteristic.

9. The circuit arrangement according to claim 6, wherein the switch-off device has a bistable switching device.

10. The circuit arrangement according to claim 6 wherein the first device comprises the electric component with a nonlinear current-voltage characteristic and a diode connected in series therewith, the anode of the diode being connected to a terminal for the at least one discharge lamp and to the at least one coupling capacitor, and the cathode of the diode being connected to the electric component with a nonlinear current-voltage characteristic, the electric component with a nonlinear current-voltage characteristic being connected to the first control input of the switch-off device, and the second device comprises a series circuit of at least one diode with at least one resistor, this series circuit being connected to the at least one coupling capacitor, a terminal for the at least one discharge lamp and to the second control input of the switch-off device.

11. The circuit according to claim 6, wherein the first control input (j3) of the switch-off device is connected in parallel in terms of alternating current with the at least one discharge lamp and monitors the voltage drop across the terminals for the at least one discharge lamp.

12. The circuit arrangement according to claim 9, wherein the bistable switching device is a thyristor equivalent circuit.

13. The circuit arrangement according to claim 9, wherein the bistable switching device has at least one terminal for supplying the bistable switching device with a holding current, the at least one terminal being connected to a voltage supply terminal by means of at least two current paths, and at least one of these current paths being led via an electrode of the at least one discharge lamp.

* * * * *